United States Patent [19]

Wahren et al.

[11] 4,081,320

[45] Mar. 28, 1978

[54] METHOD AND APPARATUS FOR SEPARATING A FIBROUS WEB FROM A FORAMINOUS BELT

[75] Inventors: Douglas Wahren; Erik Gunnar Stenberg, both of Karlstad, Sweden

[73] Assignee: Aktiebolaget Karlstads Mekaniska Werkstad, Karlstad, Sweden

[21] Appl. No.: 635,398

[22] Filed: Nov. 26, 1975

[30] Foreign Application Priority Data

Dec. 3, 1974 Sweden ..... 7415154

[51] Int. Cl.[2] ..... D21F 2/00

[52] U.S. Cl. ..... 162/205; 162/306; 162/307; 162/310

[58] Field of Search ..... 162/204, 205, 306, 307, 162/308, 310, 313, 305

[56] References Cited

U.S. PATENT DOCUMENTS

| | | | |
|---|---|---|---|
| 2,990,013 | 6/1961 | Rance et al. | 162/307 |
| 3,351,521 | 11/1967 | Murray et al. | 162/307 |
| 3,441,476 | 4/1969 | Schiel | 162/306 |
| 3,528,881 | 9/1970 | Stuebe | 162/306 |
| 3,595,745 | 7/1971 | Cronin | 162/306 |
| 3,735,929 | 5/1973 | Pleines | 162/310 |
| 3,992,254 | 11/1976 | Lehtinen | 162/300 |

*Primary Examiner*—Robert L. Lindsay, Jr.
*Assistant Examiner*—George C. Yeung
*Attorney, Agent, or Firm*—Brumbaugh, Graves, Donohue & Raymond

[57] ABSTRACT

The transfer of a fibrous web in a paper-making machine from a first foraminous belt to a second foraminous belt is facilitated by applying water to the side of the first belt opposite from the side on which the web is carried partially to wet the web, leading the second belt into engagement with the fibrous web before or after wetting it, and after the web is wet, and while the second belt is in engagement with the web, causing the water or gas pressure on the side of the web adhering to the first belt to exceed the water or gas pressure on the side of the web adjacent to the second belt.

16 Claims, 6 Drawing Figures

METHOD AND APPARATUS FOR SEPARATING A FIBROUS WEB FROM A FORAMINOUS BELT

BACKGROUND OF THE INVENTION

This invention relates to a method, and to apparatus for carrying out the method, for facilitating the transfer of a fibrous web in a paper-making machine from a first foraminous belt to a second foraminous belt. In conventional Fourdrinier paper-making machines, the fibrous web formed on a wire is usually transferred from the wire to a felt by any of a number of known pickup devices. A common form of pickup system that is used in instances in which both the web and the felt have suitable moisture contents, relative to each other, the felt is merely brought into engagement with the web, such as by leading it around a plain roll, and the web will naturally stick to the felt and will thereafter cling to the underside of the felt, even when the felt runs horizontally. In many cases, for example, in the manufacture of thin fibrous webs with low basis weights and high water and air permeability, relatively high speed paper-making machines are used. Several machines for making low basis weight paper, such as tissue and similar light grades, involve the use of two wires or a wire and a felt that are brought together to form a convergent paper-forming zone, sometimes a curved paper-forming zone, where the water is extracted from the stock through one or both wires. One form of such a machine is described and shown in U.S. Pat. No. 3,326,745. In the machine described in that patent, the forming zone is constituted by a converging arcuate space formed between a wire and a felt that are led around part of the perimeter of the forming roll. In such machines, the web and felt both have relatively high moisture contents after formation of the web and the web naturally follows the felt when the felt and wire separate.

It is difficult to separate lightweight fibrous webs, say those with a basis weight of 25 g/m$^2$ or less, from a forming wire and transfer it to a relatively dry felt when the paper-making machine runs at a speed greater than about 1300 m/min (4000 ft./min). Among the problems that occur at separation is the clinging of pieces of fibers or small pieces of web to the wire when the web is separated from the wire. With the lightweight grades of sheet, the number of long fibers that lend strength to the sheet per unit of sheet area is relatively small, and the area of contact between the fibers in the sheet is not significantly greater than the area of contact between the fibers and the wire.

In machines in which the stock is drained under significant pressure through the wire during the web forming and consolidating process, such as in the case of machines having two wires or a wire and felt trained to define a converging pressure nip constituting the forming zone, the ends of many of the fibers are forced through the strands of the wire, and capillary forces develop between the wire and the fiber ends on the side of the wire opposite from the side on which the web is carried. Such capillary forces hold the ends of the fibers against the outside of the wire and result in a relatively strong adhesion of the web to the wire. Inasmuch as the web is of relatively low strength, complete fibers or pieces of fiber and small parts of the web frequently break away from the web when the web is separated from the wire, thereby tending to make the wire dirtier, clog the wire, cause increased wire wear and result in a substantial loss of controlled forming conditions.

SUMMARY OF THE INVENTION

There is provided, in accordance with the present invention, a method, and an apparatus for carrying out that method, of facilitating the transfer of a fibrous web in a paper-making machine from a first foraminous belt to a second foraminous belt. The method is applicable primarily to the transfer of fibrous webs of a basis weight of about 25 g/m$^2$ or less, that are being made at paper-making machine speeds in excess of about 1300 m/min. The invention makes it possible to separate the web from a wire without leaving any pieces of the web or objectionable amounts of fibers or fiber pieces on the wire. The use of the method and apparatus of the present invention thus ensures clean separation of the web from the wire so that the web can thereafter be readily transferred to a felt, preferably a relatively dry felt.

In accordance with the invention, the transfer of a fibrous web from a paper-making wire to a felt is facilitated by applying water to the side of the wire opposite from the side on which the web is carried partially to wet the web. Either before or after wetting the web, a felt is led into engagement with the web, and while the felt is in engagement with the web, the water or gas pressure on the wire side of the web is caused to exceed the water or gas pressure on the felt side of the web.

The wetting of the web substantially reduces the capillary forces acting between the strands of the wire and the fibers and pieces of fibers that are close to the strands of the wire, particularly fiber ends that protrude through the wire and tend to cling to the outside of the wire. The creation of a water or gas pressure differential between the wire and felt sides of the web assists in reducing the adhesion between the web and the wire to a minimum. The combination of reducing capillary forces between the strands of the wire and the fibers of the sheet and reducing adhesion between the web and the wire make it possible to transfer the web to a relatively dry felt while leaving the web in good condition and leaving the wire in clean condition.

The invention also makes it possible to employ a paper-making wire having a relatively high drainage capacity and to use a relatively dry felt, the dry felt being a particular advantage in processing the web in the drying section of the machine in that the dry felt can accept water from the web. It has been found quite unexpectedly that the wetting of the web, in accordance with the method of the present invention, does not offset to any significant degree the advantage of using a relatively dry felt to carry the web to and through the drying section of the machine. Only a relatively small quantity of water is needed to reduce the capillary forces between the sheet fibers and the strands of the wire to the point that the web is readily separated from the wire. It is sufficient to apply water to the wire and web in an amount of approximately 10 kg per kg dry weight of the web, and with conventional felts, that amount of water added to the web adds only about 0.2 kg of water per kg total dry weight of the web and felt. Generally, the felt can be dried such that it is led into engagement with the web with a water content of about 0.3 to about 0.4 kg water per kg dry weight of felt. Even when the additional water is added to the web in accordance with the method of the present invention, the ratio of total water content of the web and felt to the total dry weight of the web and felt is substantially less than the ratio that exists in conventional pickup systems, which is usually in the upper part of the range of from 1.5 to 3.5 kg water per kg total dry weight of the web and felt.

For a better understanding of the invention, reference may be made to the following description of some exemplary embodiments considered in conjunction with the figures of the accompanying drawings. Each of the FIGS. 1–6 of the drawings is a schematic side elevational view of a different embodiment of the invention.

DESCRIPTION OF EXEMPLARY EMBODIMENTS

Figure 1:
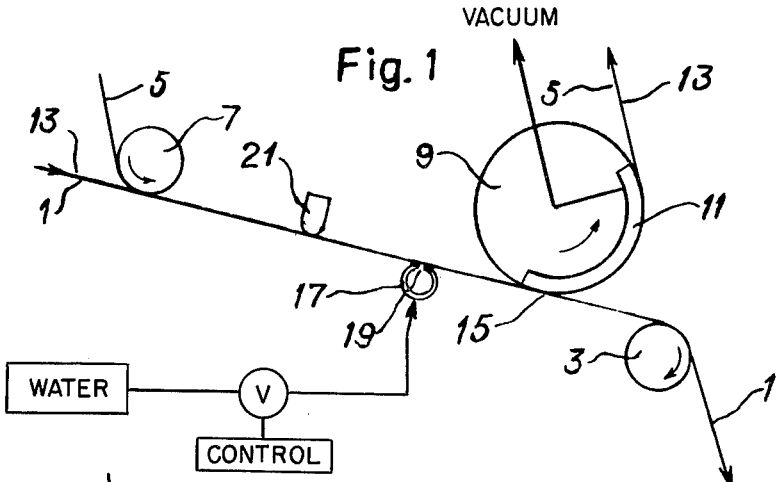

In the embodiment illustrated in FIG. 1, a paper-making wire 1 carries a newly formed fibrous web 13 from a forming section of the paper-making machine, and the wire and web are moving from left to right in the figure. The forming section of the machine may be of various types, such as the type shown in U.S. Pat. No. 3,326,745 or any of several types of paper-forming machines in which paper-making stock is drained under a relatively substantial hydrostatic pressure such as between two wires or a wire and a felt wrapped around part of the perimeter of a forming roll, over a curved fixed supporting structure or guided between supports or rolls, all of which types of forming devices provide a convergent forming zone in which hydrostatic pressure is developed in the stock to assist in draining the stock rapidly. In the case of forming rolls and shoes, substantial centrifugal forces assist in draining water from the stock through the wire. Such types of forming devices are known in the art and therefore are not described here or shown in the drawings.

The wire 1 travels from the forming section and is guided around a wire roll 3. A felt 5 is led in around a felt roll 7 into engagement with the web 13 on the wire at a point intermediate the end of the forming zone (not shown) and the wire roll 3 and travels conjointly with the wire and web to a suction pickup roll 9 having a suction box 11 extending along a part of the circumference of the roll. The line or zone of engagement between the suction pickup roll, which line or zone is designated by the reference numeral 15, constitutes a pickup point where the web 13 is picked off the wire and transferred to the felt by reason of a reduction in the gas pressure on the felt side of the web, relative to the gas pressure on the wire side of the web, due to suction in the suction box 11 in the pickup roll. The pressure differential across the web persists throughout the extent of the suction box and holds the web 13 on the felt 5 against the centrifugal force exerted on the web as it turns around the pickup roll. The felt 5 separates from the pickup roll near the end of the suction box, and the web 13 is carried by the felt to the drying section of the machine.

In the embodiment of FIG. 1, the transfer of the web from the wire to the felt is facilitated by applying water from a water supply conduit 17 that extends transversely across the wire and has a slot 19 that is co-extensive with the width of the web and faces the wire and the web. Water under pressure is supplied at a quantity and under pressures, using suitable controls (indicated schematically), to the conduit 17. The conduit 17 is pressed against the wire and is preferably sealed along either side of the slot, thus confining the stream of water to generally the area of the slot. A backup bar 21, which can be replaced by a roll, supports the wire web and felt against the pressure of the conduit against the wire. As described above, the application of water to the underside of the wire reduces capillary forces between the fibers of the web and the strands of the wire. Moreover, the hydrostatic pressure of the water assists in releasing the web from the wire. The pressure differential created by the suction box completes the separation of the web from the wire and the transfer of the web to the felt.

For the most part, the embodiments of FIGS. 2 to 6 of the drawings are the same as the embodiment of FIG. 1, and it is sufficient, therefore, merely to describe the differences. The same reference numerals are used throughout the drawings to assist in correlating the above description of FIG. 1 to the components in the embodiments of FIGS. 2 to 6.

Figure 2:
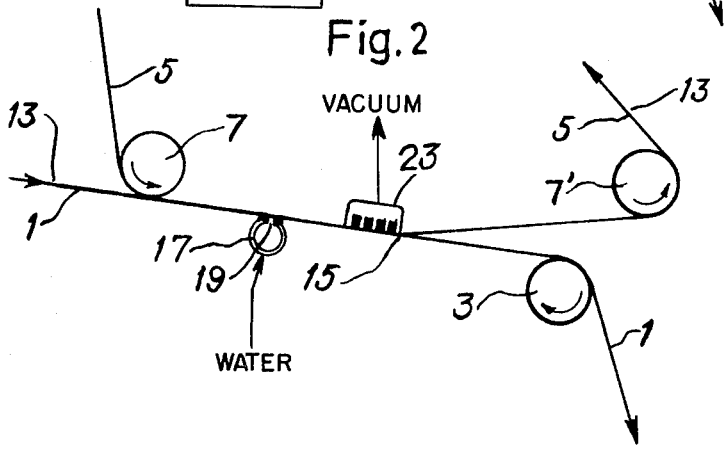

In FIG. 2, the water conduit 17 is located relatively close to the felt lead-in roll 7, and no backing bar or roll 21 (see FIG. 1) is needed. The pickup roll is replaced by a suction box 23 and the web and felt travel to a felt turning roll 7', the web clinging to the underside of the felt between the suction box 23 and the turning roll 7'.

Figure 3:
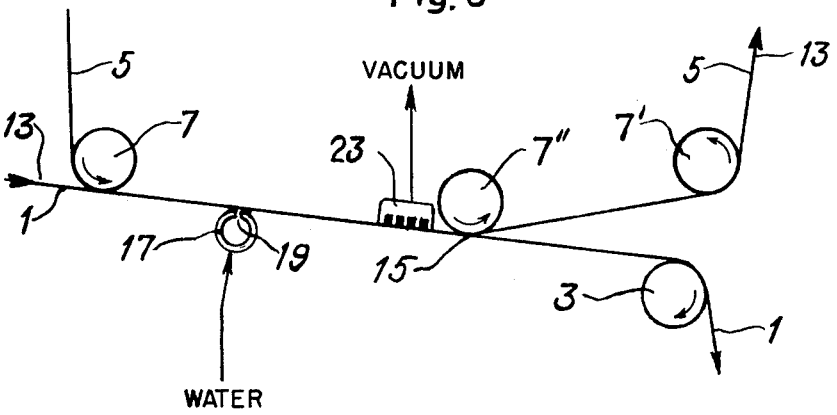

The only difference between the embodiments of FIGS. 2 and 3 is the addition of a turning roll 7'' located very close to the suction box 23, thus moving the web transfer point 15 from the trailing edge of the suction box (see FIG. 2) to the zone of engagement between the turning roll 7' and the felt.

Figure 4:
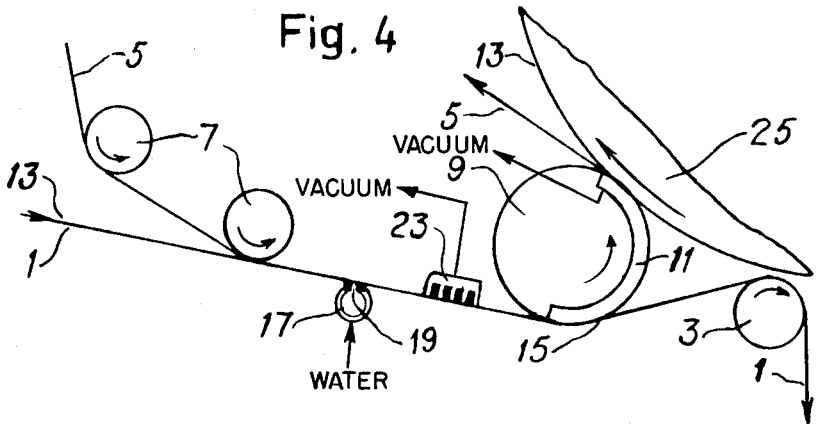

In the embodiment of FIG. 4, the wire 1, web 13 and felt 5 run conjointly over the water conduit 17, under a suction box 23, which creates a gas pressure differential across the web tending to remove it from the wire, and then around a segment of the circumference of a suction roll 9. The wire 1 then separates and is led around a wire roll 3. The suction in the suction box 11 of the suction roll 9 transfers the web to the felt, and the felt carries the web around the circumference of the suction roll 9 and presses it against a drying roll 25. Inasmuch as the drying roll is smoother than the felt, the web will stick to the drying roll at the outgoing side of the nip between the suction roll and the drying roll. The nip between the suction roll 9 and the drying roll 25 constitutes a press nip in which the web is partly dewatered. It is, of course, apparent to those skilled in the art that the web is dewatered along runs over suction boxes 23 and runs around the suction rolls 9 in each of the embodiments.

Figure 5:
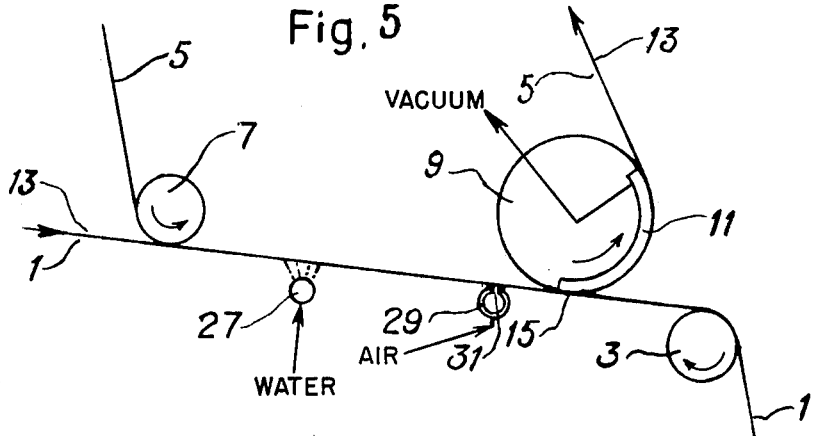
Figure 6:
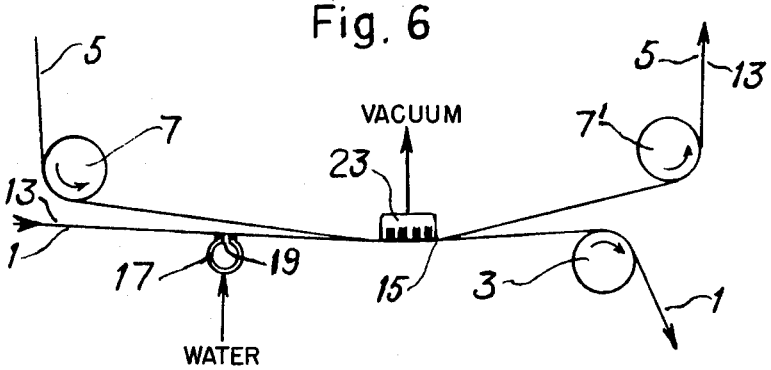

In the embodiment of FIG. 5, a water spray pipe 27 and an air pipe 29 having a slot 31 are used instead of the water supply conduit 17. The spray pipe 27 produces the wetting of the web while air under pressure is delivered to the pipe 29 and supplies a stream of air through the slot 31, which passes through the wire and creates a pressure differential across the web to reduce the adherence between the wire and the web. The web is separated from the wire and transferred to the felt at a transfer point 15 constituted by the zone of engagement of the suction roll with the wire, web and felt. In FIG. 6, the felt is not brought into engagement with the web until after water is applied from a water conduit 17 (or a spray pipe 27), but engages the web along the conjoint run of the wire, web and felt at a suction box 23 which creates a pressure differential that dewaters the web and reduces the adherence of the web to the wire. The felt is led away from the wire around a turning roll 7', the web separating from the wire and transferring to the felt at a transfer point 15 coincident with the downstream edge of the suction box 23.

We claim:

1. A method for facilitating the transfer of a fibrous web in a paper-making machine from a first foraminous belt carrying the web on one side thereof to a second foraminous belt comprising the steps of applying water to the side of the first belt opposite from the side on which the web is carried to wet the web so that capillary forces between fibers of the web and the first belt are reduced, exerting pressure on the web so that adhesion between the web and the first belt is reduced, leading the second belt into engagement with the web before or after the wetting and pressure steps, and transferring the web from the first belt to the second belt by subjecting the web to a differential pressure acting in the direction from the first belt toward the second belt after and separately from the wetting and pressure steps and while the second belt is in engagement with the web.

2. A method according to claim 1, wherein both the wetting and pressure steps are carried out simultaneously by conducting water under pressure through a slot in a conduit against the first belt, the slot engaging the said opposite side of the first belt and extending transversely across the belt.

3. A method according to claim 1, wherein the wetting step is carried out by spraying water under pressure toward the first belt transversely across the belt and the pressure step is carried out thereafter by conducting air under pressure toward the web through a slot in a conduit disposed adjacent said opposite side of the first belt and extending transversely across the belt.

4. A method according to claim 1, wherein the wetting step is carried out by conducting water under pressure through a slot in a conduit against the first belt, the slot engaging the said opposite side of the first belt and extending transversely across the belt.

5. A method according to claim 4, wherein the pressure step is carried out after the wetting step by subjecting the web to a differential pressure acting in a direction from the first belt toward the second belt.

6. An apparatus for facilitating the transfer of a fibrous web in a paper-making machine from a first foraminous belt on which the web is carried to a second foraminous belt comprising means for applying water to the side of the first belt opposite from the side on which the web is carried to wet the web so that capillary forces between fibers of the web and the first belt are reduced, means for exerting pressure on the web so that adhesion between the web and the first belt is reduced, means for leading the second belt into engagement with the web before or after the web is wetted and pressure is exerted on the web, and pick-up means for transferring the web from the first belt to the second belt including means for subjecting the web to a differential air pressure acting in a direction from the first belt toward the second belt after the web is wetted and pressure is exerted on the web and while the second belt is in engagement with the web.

7. An apparatus according to claim 6, wherein the water applying means is also the pressure applying means and includes a water delivery conduit engaging the first belt, the conduit including a slot communicating with the first belt and extending transversely across the belt, and means for conducting water under pressure into the conduit and out the slot.

8. An apparatus according to claim 6, wherein the water aplying means includes a water spray pipe for spraying water transversely across the first belt, and the pressure applying means includes an air pipe for conducting air under pressure against the first belt after water is sprayed across the first belt.

9. An apparatus according to claim 6, wherein the pick-up means is a suction pickup roll.

10. An apparatus according to claim 6, wherein the pick-up means is a suction box.

11. Apparatus according to claim 6, wherein the water applying means includes a water delivery conduit extending transversely across the first belt and engaging the belt and having a slot communicating with the belt, and means for conducting water under pressure into the conduit for delivery out through the slot.

12. Apparatus according to claim 11, wherein the pressure applying means includes means for subjecting the web to a differential air pressure acting in a direction from the first belt toward the second belt.

13. An apparatus according to claim 6 and further comprising means supporting the first belt and the second belt and providing a conjoint run of the first belt and the second belt with the web between them along a predetermined path and wherein the conduit is located along side the conjoint run.

14. An apparatus according to claim 13 further comprising means engaging the second belt for backing up the first belt, the web and the second belt along the conjoint run and holding the first belt under pressure against the water delivery conduit.

15. An apparatus according to claim 14, wherein said backup means is a belt turning roll which also leads the second belt into engagement with the web.

16. An apparatus according to claim 14, wherein the backup means is a backing bar.

* * * * *